US005989164A

United States Patent [19]

Kullman et al.

[11] Patent Number: 5,989,164

[45] Date of Patent: Nov. 23, 1999

[54] SAFETY APPARATUS FOR WEIGHT LIFTING

[76] Inventors: Lawrence W. Kullman, 200 E. 33rd St., New York, Manhattan County, N.Y. 10016; Richard J. Maiaro, 161 Harding Dr., New Rochelle, Westchester County, N.Y. 10801

[21] Appl. No.: 08/835,993

[22] Filed: Apr. 11, 1997

Related U.S. Application Data

[63] Continuation of application No. 08/438,747, May 10, 1995, abandoned.

[51] Int. Cl.[6] ..... A63B 21/078

[52] U.S. Cl. ..... 482/93; 482/104

[58] Field of Search ..... 482/93, 94, 104, 482/106, 5, 6

[56] References Cited

U.S. PATENT DOCUMENTS

| | | | |
|---|---|---|---|
| 4,249,726 | 2/1981 | Faust | 482/104 X |
| 4,799,673 | 1/1989 | Selle | 482/104 |
| 4,807,875 | 2/1989 | Tanski | 482/104 |
| 4,949,959 | 8/1990 | Stevens | 482/104 |
| 5,048,826 | 9/1991 | Ryan | 482/104 X |

*Primary Examiner*—John Mulcahy
*Attorney, Agent, or Firm*—Morris I. Pollack

[57] ABSTRACT

A free standing frame or one carried by a barbell holder mounts a safety apparatus. The safety apparatus has a catch which may be a set of bars, loops or other arrangements deployed to coact with a bar of the barbell proximate each end of the barbell when an unsafe condition exists and move the barbell out of harms way. The safety apparatus is used with free weights in order to prevent injury to the weight lifter. Such injury may occur when the weight lifter is fatigued or some other emergency does not allow the weight lifter to complete another repetition. In such a case the barbell and attached weights are automatically moved to a safe position. The catch is attached to a line which in turn is attached to a wind up device. Prior to attachment to the wind up device the orientation of the lines are changed from vertical to essentially horizontal by passing over a pulley or other cylindrical member being attached to a motor. The motor which is attached to the wind up device is activated automatically or manually when danger to the weight lifter is imminent. After activation and removal of the barbell and weight from endangering the weight lifter the system is reset and ready for use once again.

25 Claims, 4 Drawing Sheets

FIG. 1B
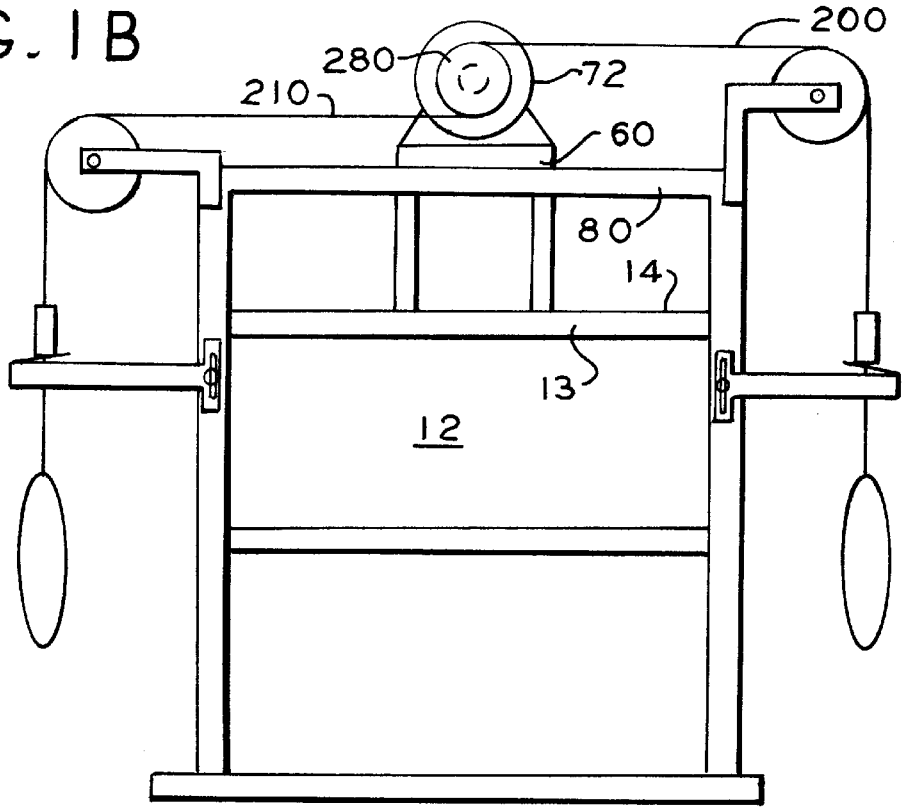
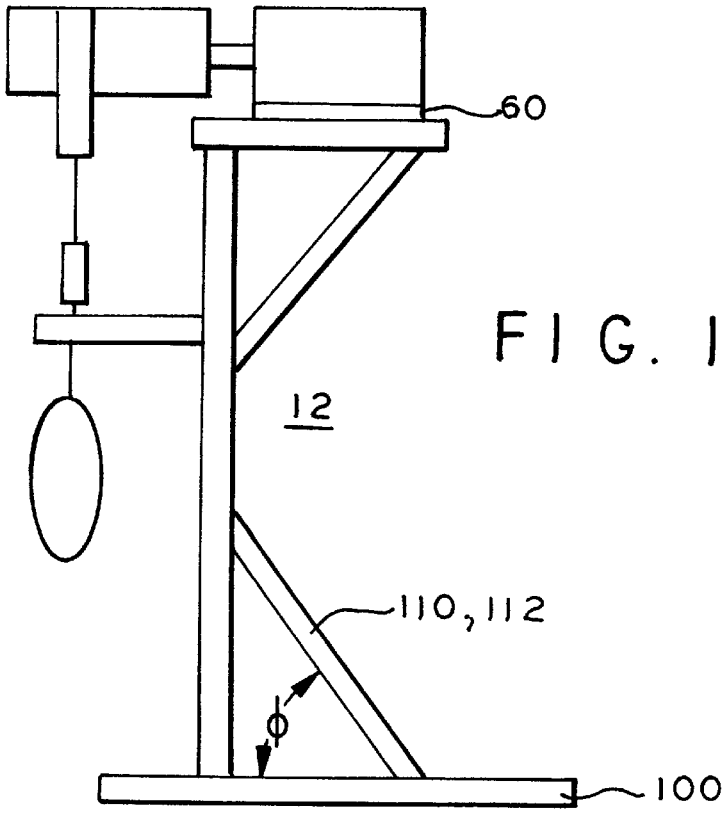
FIG. 1C

OR

SAFETY APPARATUS FOR WEIGHT LIFTING

This application is a continuation of application Ser. No. 08/438,747 filed on May 10, 1995 and now abandonded which designated the U.S.

BACKGROUND OF THE INVENTION

1. Field of Application

This invention generally relates to equipment used for weight lifting, and more specifically to safety devices employed to protect a weight lifter from a barbell dropping on their body.

2. Description of the Prior Art

The use of barbells, i.e. free weights, for conditioning and enhancement of the body's musculature is widely practiced by a variety of people. Often these people prefer to weight lift in the privacy of their home ,and when they feel like weight lifting.

Most common weight training is executed with a spotter (i.e. someone who can assist the lifter when they become fatigued or are having difficulty or are about to drop the weight). Communication of the proper time to assist is difficult in the best of circumstances. The inconvenience to the spotter and the uncertainty of the assistance when losing control are major deterrents to using a spotter. However to weight lift alone (i.e., without a spotter) may be dangerous to the weight lifter. Without a spotter to grab the barbell and prevent the barbell from dropping on the weight lifter there is a significant danger of serious injury due to fatigue, or improper technique. Although this situation most likely occurs while engaged in private recreational lifting, the same danger exists for the professional during competition and at exercise gyms. In addition to the dangers with barbells similar dangers exist when using a stack of weights.

Three weight lifting modes are the bench press, squat and deadlift. The danger of crushing ones chest during the bench press is of great concern, people have been known to break a leg during squats. U.S. Pat. No. 5,273,506 to Fedric O. Dawson, Jr. shows a device with stops which is to act in stead of a spotter. While his device will stop the movement of the weights it does not help in the removal of the weights. King shows an air lift apparatus in U.S. Pat. No. 4,848,738 which can be used with a weight stack which is fixedly attached to the stack. Hydraulic jacks are used by William L. Barrett (as shown in U.S. Pat. No. 4,799,672) which do not interact with the weights, as do the devices of the previous mentioned Patents while U.S. Pat. No. 4,253,662 issued to Wayne S. Podolak shows an apparatus fixedly attached to the barbell.

The need for a barbell activated safety device is not fully met by the above mentioned devices and systems. None have automatic initiating of the safety device, without intervention by the weight lifter, and most are fixedly attached to the barbell or weights. All previous safety devices seem to have limitations due to their concept complexity or lack of automatic activation.

SUMMARY OF THE INVENTION

It is therefore an object of this invention to provide a new and novel safety device or apparatus for an individual while engaged in the activity of weight lifting.

It is another object of this invention to provide a new and novel safety apparatus when compared with devices of the prior art.

It is still another object of this invention to provide a new and novel safety device that acts in stead of a spotter.

It is yet another object of this invention to provide a new and novel device which automatically activates.

It is still yet an other object of this invention to provide a new and novel weight lifting safety device that allows the weight lifter the option of manually activating the device, using any one of a variety of activating means.

It is yet still an other object of this invention to provide a new and novel safety device which does not have contact with any part of the weight while lifting is in progress unless and until a dangerous situation arises.

It is another object of the invention to provide a new and novel weight lifting safety device wherein the mechanism is adjustable for the individual and the type of exercise being performed.

The invention is comprised of the apparatus which has the elements, arrangements of components and construction detailed in the following disclosure. A more comprehensive understanding of the invention can be oblitained by referencing the following detailed description taken with the drawings.

BRIEF DESCRIPTION OF THE DRAWINGS

FIG. 1B is a front elevation view of the apparatus of FIG. 1 and FIG. 1A;

FIG. 1C is a side elevation view of the apparatus of FIGS. 1–1A–1B;

DESCRIPTION OF THE PREFERRED EMBODIMENTS

Figure 1:
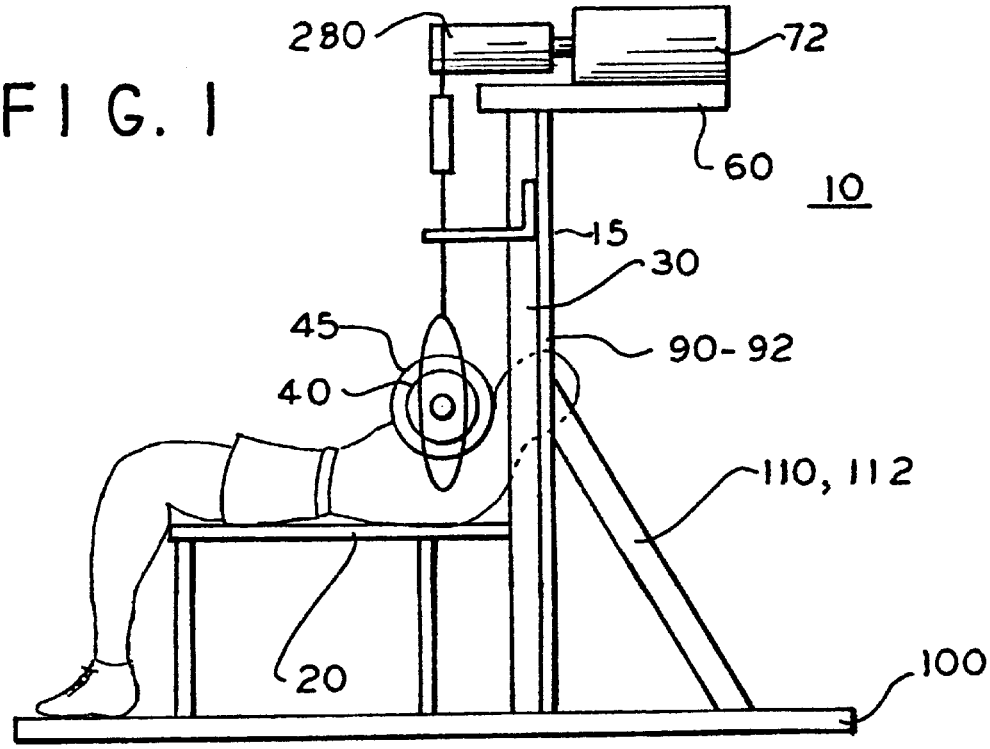
FIG. 1 is an side elevation view of safety apparatus incorporating the instant invention being used by a weight lifter exercising on a bench.
Figure 1A:
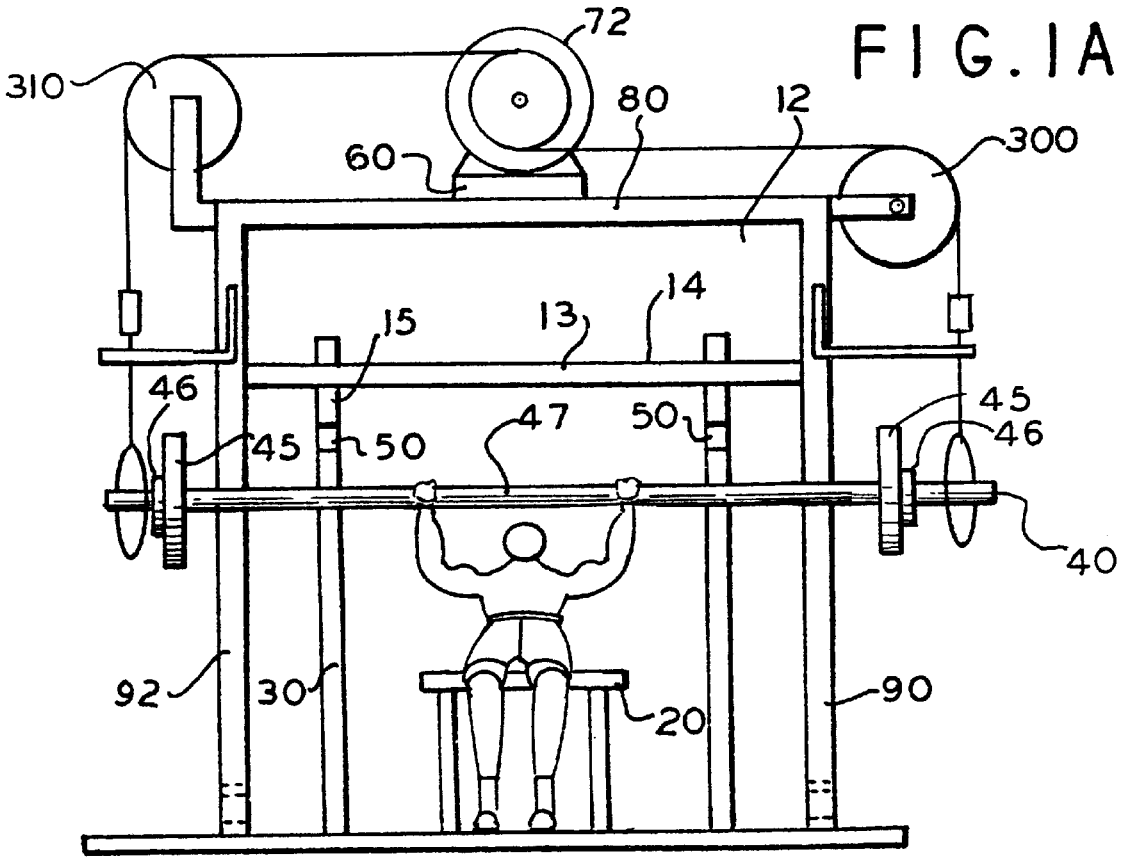
FIG. 1A is a front elevation view of the equipment of FIG. 1.

Reference is now made to FIGS. 1 and 1A in which is shown a safety apparatus 10 being used by a weight lifter in conjunction with a conventional bench 20 and a conventional barbell rack 30. Rack 30 supports a conventional barbell 40 equipped with a set of weights 45 that are disposed in a holder 50 when not in use. A pair of clamps 46 and a sleeve 47 are deployed to contain weights 45 on barbell 40 in a conventional manner. Alternatively apparatus 10 may be fixedly secured to the floor proximate rack 30 or may otherwise be fixedly disposed or constructed to be free standing proximate rack 30. Safety apparatus 10 is fixedly secured to rack 30 by conventional means such as welding, bolting or the like. A frame 12 of apparatus 10 is disposed proximate rack 30 so that a front surface 13 of a cross bar 14 of frame 12 and a back surface 15 of rack 30 are fixedly attached to each other. A motor mounting plate 60 is fixedly attached to frame 12 central to a top member 80 thereof. Top 80 is fixedly attached to a right side member 90 and a left side member 92 of frame 12. A support member 15 is similarly disposed between side members 90 and 92 essentially parallel to top member 80 .A base 100 extends to the rear of bench 20 and perpendicular to sides 90 and 92 and parallel to mounting plate 60. A pair of support members 110 and 112 are fixedly attached to base 100 and sides 90 and 92 respectively at a predetermined angle 0.

Figure 3:
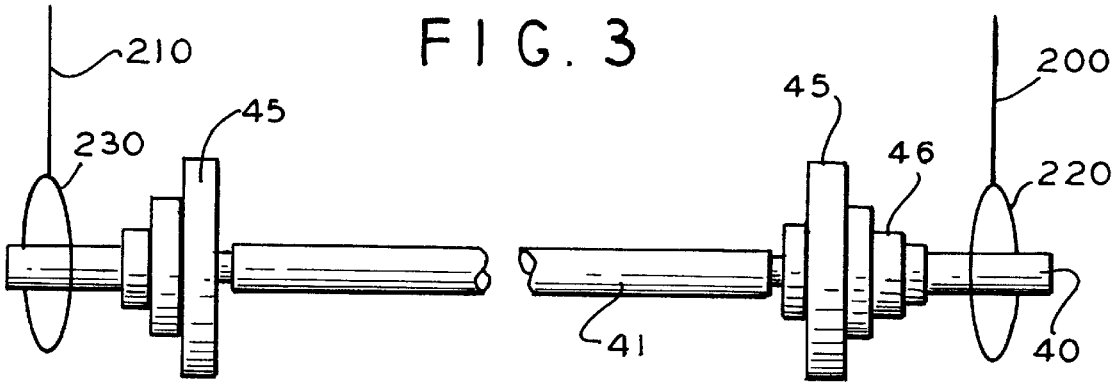
FIG. 3 is an enlarged view of the deployment of the cable around the barbell.
Figure 3B:
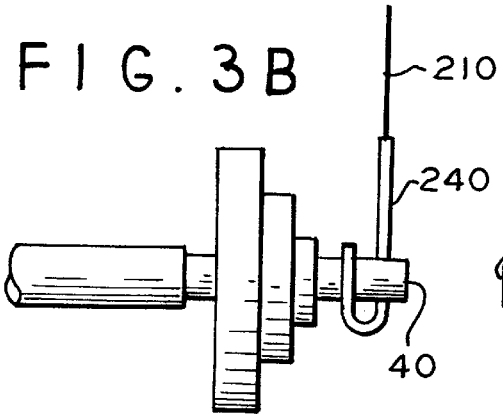
FIG. 3B is an enlarged view of the deployment of a J hook below the barbell.
Figure 3A:
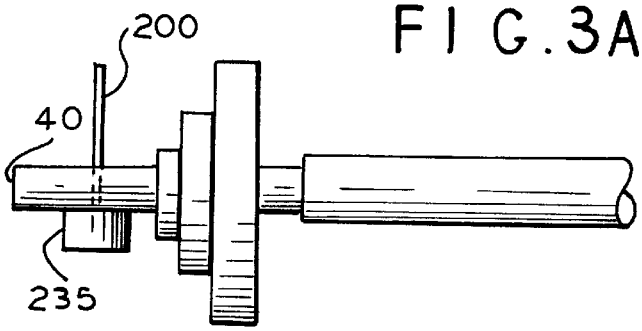
FIG. 3A is an enlarged view of the deployment of a rigid member below the barbell.

In FIG. 3 a pair of cables 200 and 210 of safety device 10 are disposed to co-act with barbell 40 when barbell 40 is in a position which will be dangerous to the weight lifter i.e., extended to a position at which barbell 40 would start to impinge upon the weight lifter. The ends of lines 200&210 are each formed into loops 220 &230 respectively. Loops 220&230 are disposed to surround but not touch barbell 40 in the normal course of weight lifting. In another configuration loops 220&230 may be replaced with a set of rigid members 235 one of each being fixedly attached proximate the ends of cables 200&210(FIG. 3A). In FIG. 3B yet another configuration is shown, a J or hook is fixedly attached proximate the end of each cable or line 200&210. All configurations i.e., loops 220&230, rigid members 235, and hooks 240 are all disposed to co-act with barbell 40 comprising safety catches therefore when safety apparatus 10 is activated. Cables or lines 210, 220 may be nylon, flax, cotton or other suitable material rope, wire rope, chain, leather strap or the like. Although the safety catches are shown deployed proximate the ends of barbell 40 they may be deployed any where along the length of barbell 40 separated by some predetermined distance.

Figure 4:
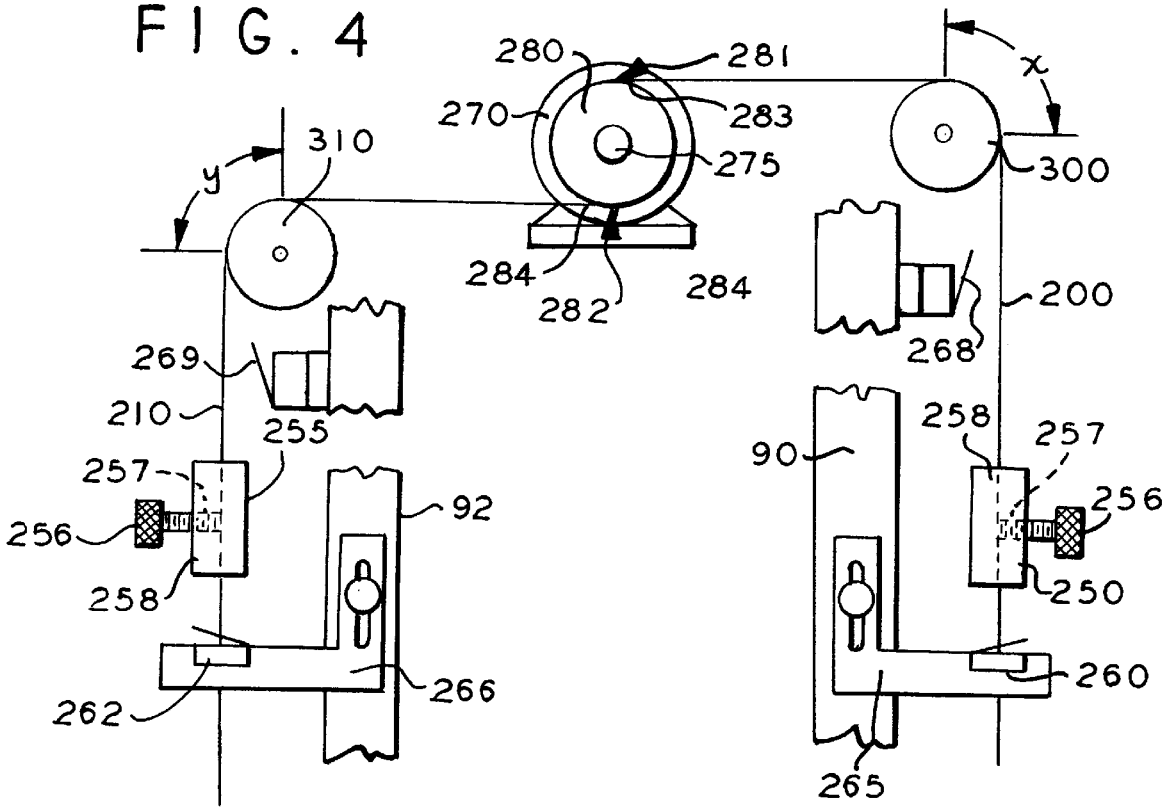
FIG. 4 is an enlarged view of the automatic switch activation arrangement.
Figure 4:
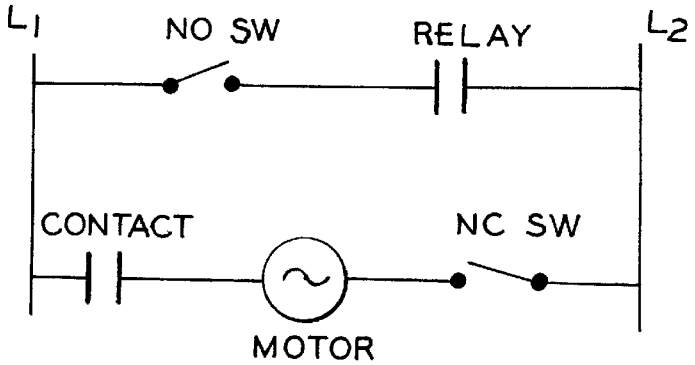
Figure 5:
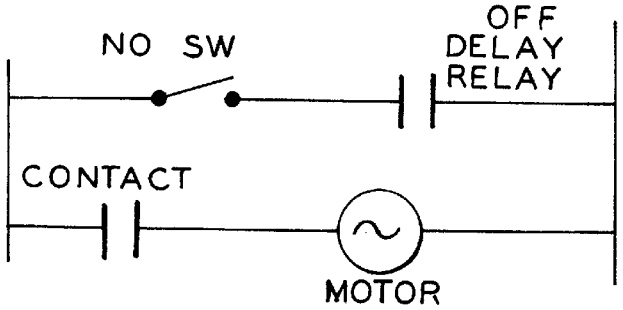
FIG. 5 is schematic diagram of the control circuit for the automatic activation of the apparatus.

With reference to FIG. 4 a set of activators 250 and 255 are ajustably attached to cables 200& 210. A thumbscrew 256 is deployed in a tapped hole disposed longitudinally through a wall of activators 250& 255. A set of switches 260 &262 are deployed on a set of brackets 265&266 which are adjustably attached to sides 90 and 92. Closing of either switch 260 or 262 starts a motor 270. An output shaft 275 of motor 270 is fixedly attached to a drum 280 which may comprise a set of rods disposed in a disc and parallel to output shaft 275 of motor 270. Cables 200& 210 are fixedly attached to drum 280. Cable 200 is deployed over an arc x of a pulley 300 so that cable 200 is perpendicular to itself after passing over pulley 300 for the arc x. At a top 281 of drum 280 an end 283 of cable 200 is fixedly attached to drum 280. Similarly cable 210 is deployed over an arc y on pulley 310 so that cable 210 is perpendicular to itself after passing over arc y of pulley 310. At a bottom 282 of drum 280. Motor 270 may be either an AC or a DC motor and may be a gear motor an end 284 of cable 210 is fixedly attached to drum 280.

Safety device 10 is activated when switch 260 is tripped at a preset position; that position being the point at which the barbell bar coacts with catches 220 and 230 or other configurations thereof as will be hereinafter described in greater detail. The tripped switch starts motor 270 with drum 280, or similar windup device, fixedly attached thereto thus winding up cables 200 and 210 to effect a further coaction of catches with the barbell bar removing the weight from the lifter and establishing a safe condition. In the case of an emergency, the present invention will automatically act as a spotter and prevent the weight from falling onto the user whereby the individual could be harmed. The present invention also provides for the actuation of the safety device to be initiated by the lifter if fatigue or other circumstances so warrant. In these circumstances activation may be by any of the following signaling means: a voice activated switch, a hand activated switch, a foot activated switch, an electric eye activated switch or the like all connected to the and operating motor 270 as described.

The present invention provides a motor with a drum connected to the output shaft of the motor. Attached to the drum are two cables extending horizontally from the drum and essentially parallel to the floor, the cables each pass over sheaves so that their direction is perpendicular to the original orientation of the weight. At the termination of each cable is a catch attached to the cable. The catch may be external to the weights attached to the barbell and hang so that no contact is made with the barbell during the normal weight-lifting. Contact of barbell and catches is only made when a dangerous situation arises.

A set of adjustable collars 250 and 255 are attached to each cable, collars 250 and 255 are held in position by a set screw 256. At some predetermined distance after cable 200 and 210 pass over a set of sheaves 300 and 310 adjustable collars 250 and 255 are attached to each cable. Collars 250 &255 interact with a set of switches 260 and 262 respectively to automatically activate safety device 10, a second pair of switches 268 and 269 are activated as the cable is wound up a predetermined amount thus preventing the dangerous deployment of the barbell and weights. Second switches 268 and 269 shut off motor 270 and device 10 is ready to be reset. In another embodiment of the invention the safety apparatus is shut down and reset by a timer which is activated by switches 250 and 255. Switches 260, 262, 268 and 269 may be mechanically operated, optically operated, infra-red operated or proximity operated type switches.

Figure 2:
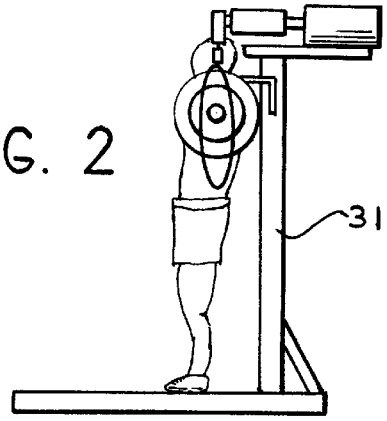
FIG. 2 is an elevation view of an alternate embodiment incorperating the instant invention the apparatus being used in conjunction with a lifter performing "squats"

The apparatus may be used without bench 20 such as shown in FIG. 2 where the barbell is deployed in a squat exercise barbell holder 31 used to hold the barbell when the weight lifter is not executing squats. It is also possible to use weight lifter activated devices such as a hand switch, foot switch or voice activated switch. Other switching techniques such as photo electric switches, laser switches or similar non contact switching devices are also possible.

What is claimed is:

1. A safety apparatus for weight lifting apparatus in conjunction with a standard barbell holder and barbell, including a barbell bar and weights, the safety apparatus comprising:

a.) safety catch means disposed for co-action with the barbell bar;

b.) line means attached to said safety catch means and, in a first disposition of said line means, to position said safety catch means for co-action with the barbell bar but not co-acting with the barbell bar during safe use thereof;

c.) said line means being movable to a second disposition upon co-action of said safety catch means with the barbell bar when an unsafe condition arises to effect movement of the barbell bar and weights when carried thereby to a safety position;

d.) said line means also including a first end attached to said safety catch means;

e.) said line means also being configured to be secured to a wind up means for winding up and letting out said line means;

f.) support means disposed proximate the barbell holder and carrying said windup means;

g.) motor means carried by said support means for co-action with said windup means;

h.) control means responsive to the movement of said line means to said second disposition thereof to energize said motor means and activate said windup means; and i.) said safety catch means constituting a self-loop of said line means disposed proximate a first end of said line means and of sufficient size to allow weight lifting without the barbell bar touching said loop in the normal course of weight lifting and to co-act with the barbell bar in the event of the unsafe condition.

2. The safety apparatus of claim 1 wherein said safety catch means further constitutes a second self-loop of said line means disposed proximate a second end of said line means and of sufficient size to allow weight lifting without the barbell bar touching the loop in the normal course of weight lifting and to co-act with the barbell bar in the event of the unsafe condition, said self-loop and said second self-loop to be disposed for co-action proximate respective ends of a barbell bar.

3. The safety apparatus of claim 1 wherein: said support means is attached to the barbell holder.

4. The safety apparatus of claim 1 wherein: said support means is separate from the barbell holder.

5. The safety apparatus of claim 1 wherein: said line means is a wire cable.

6. The safety apparatus of claim 1 wherein: said line means is a rope.

7. The safety apparatus of claim 1 wherein: said line means is a chain.

8. The safety apparatus of claim 1 wherein: the weightlifting to be performed includes bench presses.

9. The safety apparatus of claim 1 wherein: the weightlifting to be performed includes squats.

10. The safety apparatus of claim 1 wherein: said control means includes;

a.) first switch means disposed to be activated by movement of said line means into said second disposition thereof and co-acting with said motor means to activate same and move a barbell bar to the safety position; and b.) second switch means to energize said motor means to effect movement of said line means to said first disposition thereof.

11. The safety apparatus of claim 10 wherein said control means also includes user activated switch means to activate said motor means and move a barbell bar to the safety position.

12. A safety apparatus for weightlifting to be used in conjunction with a barbell holder and barbell including a barbell bar and weights, the safety apparatus comprising:

a) safety catch means to be disposed for coaction with a barbell bar; and b) line means attached to said safety catch means and so as to be disposed in a first disposition to position said safety catch means for coaction with a barbell bar but so as to not coact with the barbell bar during safe use thereof;

c) motive means coacting with said line means to effect movement thereof;

d) said line means, when so disposed, also positioning said safety catch means so that when an unsafe condition arises said safety catch means will coact with a barbell bar to effect movement of said line means to a second disposition to thereby actuate said motive means to effect movement of the barbell bar and weights, when carried thereby, to a safety position.

13. The safety apparatus of claim 12, wherein:

a.) said line means includes a first end attached to said safety catch means;

b.) said line means also being secured to a windup means for winding up and letting out said line means;

c.) support means to be disposed proximate a barbell holder and carrying said windup means;

d.) motor means carried by said support means for co-action with said windup means; and e.) control means responsive to the movement of said line means to said second disposition thereof to energize said motor means to activate said windup means to move the barbell bar and weights when carried thereby to a safety position.

14. The safety apparatus of claim 13 wherein:

said support means is configured to be attached to the barbell holder.

15. The safety apparatus of claim 13 wherein:

said support means is configured to be separate from the barbell holder.

16. The safety apparatus of claim 13 wherein said line means also includes a second end attached to said safety catch means.

17. The safety apparatus of claim 16 wherein:

a.) said safety catch means includes a first safety catch device attached to said first end of said line means and a second safety catch device attached to said second end of said line means, each said safety catch device to be disposed to allow weightlifting without a barbell bar touching said safety catch means in the normal course of weight lifting and so as to co-act with a barbell bar in the event of an unsafe condition;

b.) said first and said second safety catch devices being configured to be respectively disposed proximate the ends of the barbell bar.

18. The safety apparatus of claim 17 wherein said safety catch devices are each J hooks.

19. The safety apparatus of claim 17 wherein said safety catch devices are each rigid members each of which is disposed perpendicular to said line means.

20. The safety apparatus of claim 13 wherein: said control means includes;

a.) first switch means disposed to be activated by movement of said line means into said second disposition thereof and co-acting with said motor means to activate same and move a barbell bar to the safety position; and b.) second switch means to energize said motor means to effect movement of said line means to said first disposition thereof.

21. The safety apparatus of claim 20 wherein said control means also includes user activated switch means to activate said motor means and move a barbell bar to the safety position.

22. The safety apparatus of claim 12 wherein:

said line means is a wire cable.

23. The safety apparatus of claim 12 wherein:

said line means is a cotton or flax rope.

24. The safety apparatus of claim 12 wherein:

said line means is a chain.

25. A safety apparatus for weightlifting to be used in conjunction with a barbell holder and barbell including a barbell bar and weights, the safety apparatus comprising:

a) safety catch means to be disposed for coaction with a barbell bar;

b) line means including a first end and a second end each attached to said safety catch means and so as to be disposed in a first disposition to position said safety catch means for coaction with a barbell bar but so as to not coact with the barbell bar during safe use thereof;

c) said line means, when so disposed also positioning said safety catch means so that when an unsafe condition arises said safety catch means will coact with a barbell bar to effect movement of said line means to a second disposition to thereby effect movement of the barbell bar and weights, when carried thereby, to a safety position;

d) said safety catch means including a first safety catch device configured as a self loop of said line means and disposed proximate a first end of said line means and a second safety catch device configured as a self loop of said line means and disposed proximate a second end of said line means, each said safety catch device to be disposed to allow weightlifting without a barbell bar touching said safety catch means in the normal safe use course of weightlifting and so as to coact with a barbell bar in the event of an unsafe condition to effect said movement thereof to said safety position;

e) said line means also being secured to a windup means for winding up and letting out said line means;

f) support means to be disposed proximate a barbell holder and carrying said windup means;

g) motor means carried by said support means for coaction with said windup means; and h) control means responsive to the movement of said line means to said second disposition thereof to energize said motor means to activate said windup means to move the barbell bar and weights, when carried thereby, to said safety position.

* * * * *